United States Patent [19]

Sorenson

[11] 4,440,991

[45] Apr. 3, 1984

[54] ELECTRIC SWITCH WITH NESTED TERMINALS

[75] Inventor: Richard W. Sorenson, Avon, Conn.

[73] Assignee: Carlingswitch, Inc., West Hartford, Conn.

[21] Appl. No.: 309,458

[22] Filed: Oct. 7, 1981

[51] Int. Cl.[3] ..... H01H 21/00

[52] U.S. Cl. ..... 200/6 R; 200/302.1

[58] Field of Search ..... 200/6 R, 6 B, 6 BA, 200/6 BB, 16 C, 67 G, 284, 293, 295, 302, 303

[56] References Cited

U.S. PATENT DOCUMENTS

| | | | |
|---|---|---|---|
| 2,961,519 | 11/1960 | Sadowsky et al. | 200/6 R X |
| 3,165,604 | 1/1965 | Sorenson | 200/6 R X |
| 3,165,611 | 1/1965 | Hagberg | 200/159 R |
| 3,322,914 | 5/1967 | Puccini | 200/67 G |
| 3,403,237 | 9/1968 | Wysong | 200/67 G |
| 3,536,872 | 10/1970 | Gilardenghi | 200/67 G |
| 4,241,244 | 12/1980 | Swann | 200/16 C X |

*Primary Examiner*—J. R. Scott

*Attorney, Agent, or Firm*—McCormick, Paulding & Huber

[57] ABSTRACT

The electric switch includes a molded dielectric case having an upwardly open cavity containing a movable contact operated by an operating member movably mounted to the case. Stationary terminals are mounted in the switch case bottom wall. A divider wall in the cavity forms sub-cavities which isolate the terminals. A skirt having an H-shaped cross sectional geometry separates the terminals from each other on the switch case body portion underside bottom wall. The unique nesting arrangement of the stationary terminal blade portions are confined within the switch case bottom wall periphery to allow attachment of conventional wire connectors which are crimped to the ends of relatively heavy circuit wires.

4 Claims, 6 Drawing Figures

ELECTRIC SWITCH WITH NESTED TERMINALS

BACKGROUND OF THE INVENTION

This invention relates generally to miniature electric switches, and deals more particularly with front panel mounted miniature switches having terminals of conventional size nested in the bottom wall of the switch case.

The chief aim of the present invention is to provide a unique nesting arrangement for the blade portions of the terminals of a miniature switch such that these terminal blade portions are all provided within the confines of the bottom wall of the switch, and so that they nevertheless are adapted to receive conventional wire connectors of the type capable of being crimped to the ends of relatively heavy wires.

In carrying out the foregoing aim of the present invention an electric switch is provided having a molded case of dielectric material, which case includes a generally rectangular body portion adapted to fit loosely within the confines of a relatively small size rectangular panel opening. The switch case body portion defines an upwardly open cavity to house the various contacts normally provided within such a switch, and an operating member is movably mounted in the switch case for selectively moving one contact relative to another generally fixed in the switch case. The switch case body portion further includes a bottom wall having slots defined therein and the electrically conductive terminals are provided in these slots. These terminals have lower portions in the form of blade shaped elements for slidably receiving wire connectors of the type generally provided with relatively high current and/or high voltage wires. These blade portions all project downwardly from the bottom wall of the switch case body portion and are arranged within the periphery of the rectangular body portion so as to permit the switch case to be front mounted in a panel. Upper portions of these terminals define the contacts which are fixed in the switch case cavity and selectively engageable by the movable contact. Some of the terminals have an intermediate portion in the plane of the blade portion and defining an offset between said upper contact defining portion and the lower blade portion with the result that at least one vertically extending edge of the projecting blade portion of the terminal is located adjacent to an outside corner of the rectangular body portion of the switch case. More particularly, each terminal comprises a flat planar strip of conductive material having a thickness which is constant throughout its length such that each terminal can be inserted upwardly into the switch case and crimped at the upper end to secure it in place. An intermediate portion of each such terminal defines the point of maximum width and also defines an abutment edge cooperating with a stepped area of the slot in the bottom wall of the switch case body portion so that the precise location for the terminal within the switch case body is accurately defined. At least four such terminals can be provided at the four corners of the generally rectangular body portion with the result that all corner terminals are arranged in generally parallel relationship to the diagonals of the rectangularly shaped switch case body portion. Center terminals may also be provided and these too are of flat planar conductive material with offset portions to permit the upper contact defining portion to be located inside the switch case cavity and to nevertheless provide the outside edge of the blade portion at the periphery of the switch case body portion itself. Finally, the switch case body portion bottom wall further defines a depending skirt means integrally formed of the same dielectric material and adapted to separate the terminals and their associated wire connectors one from another.

DESCRIPTION OF THE PREFERRED EMBODIMENT

Figure 1:
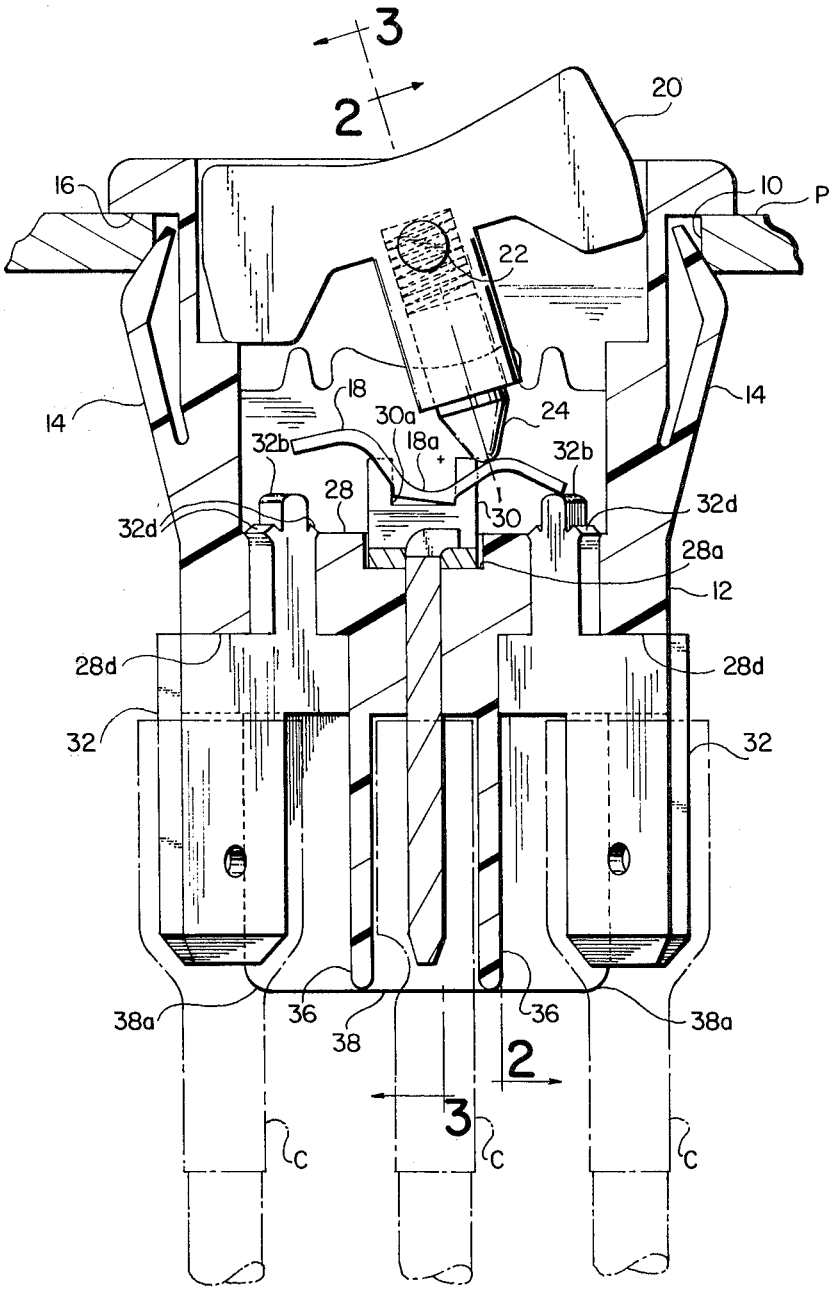
FIG. 1 is a vertical cross sectional view of a miniature switch incorporating the present invention and is taken generally on the line 1—1 of FIG. 4. Wire connectors for the depending blades of the switch terminals are illustrated in phantom lines for reference purposes in both FIGS. 1 and 4.

Turning now to the drawings in greater detail, the miniature switch of the present invention is intended to be secured in a panel opening provided for it, and more particularly to be front mounted in such panel opening. FIG. 1 shows the panel opening 10 in the panel P as being large enough to receive the generally rectangular switch case body portion 12 as it is so mounted. The switch case body portion further includes upstanding wings 14 in the form of integrally connected resilient arms such that the switch case can be moved downwardly into the panel opening 10 deforming these wings 14, 14 until a periphery extending flange 16 on the upper or outer portion of the switch case engages the front of the panel P and so that the wings 14, 14 are allowed to expand outwardly and thereby secure the switch case in the opening 10.

Figure 2:
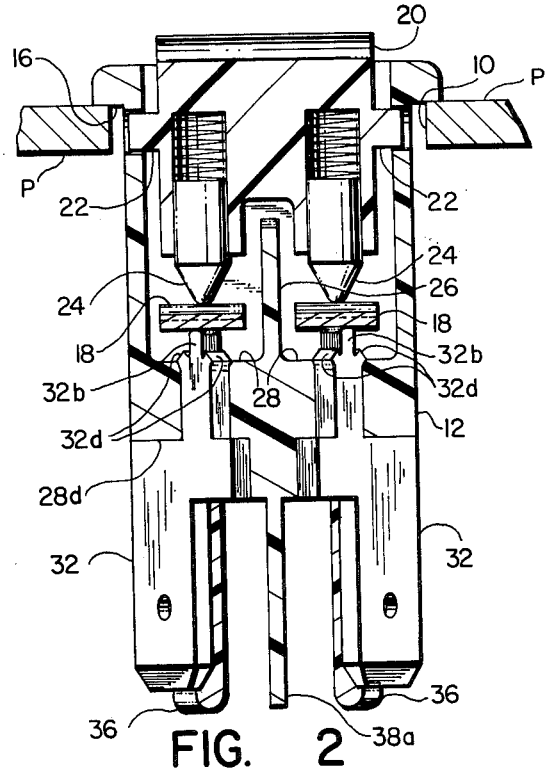
FIG. 2 is a vertical sectional view taken generally on the line 2—2 of FIG. 1.
Figure 3:
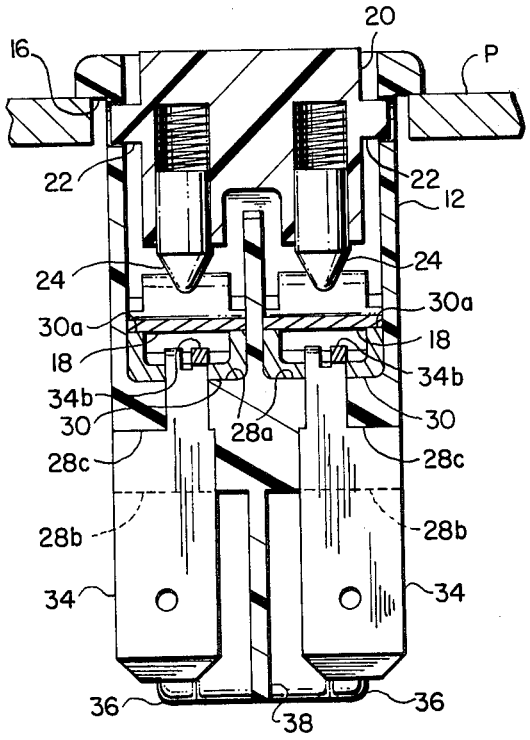
FIG. 3 is a vertical sectional view taken generally on the line 3—3 of FIG. 1.

As best shown in FIGS. 2 and 3 the switch illustrated in the drawings is a double pole double throw type switch having two sets of contacts located in two subcavities defined within the switch case body portion 12, as well as two movable contact elements 18, 18. A movably mounted operating member 20 is pivotally supported in the switch case for movement about projecting pivot points 22, 22 to achieve movement of the movable contact elements 18, 18 from the position shown in FIG. 1 to an alternative position (not shown) wherein the center terminal of the switch is electrically connected to the left hand terminal rather than to the right hand terminal as shown. The operating member 20 is preferably a rocker in the embodiment shown and defines downwardly open cavities for slidably receiving spring biased plungers 24, 24 which plungers are adapted to engage the movable contact members 18, 18. It is a feature of the switch illustrated in FIG. 1 that each contact member 18 not only has the two limit positions described above but also has a center "off" position determined when the plunger 24 is located in the valley **18*a* defined by the generally V-shaped movable member 18**.

The switch case body portion 12 has integrally connected side and end walls as shown in FIGS. 1, 2 and 3, which walls cooperate to define an upwardly open cavity in which the movable contact member 18 is adapted to move as described above, and in which fixed contacts are defined at the upper ends of terminals to be described hereinbelow. More particularly this upwardly open cavity of body portion 12 further includes a center divider wall 26 extending between the end walls of the switch case 12 and this wall 26 divides the cavity of the body portion 12 into two subcavities as best shown in FIGS. 2 and 3. These subcavities are further defined by a bottom wall 28 also integrally connected to the side and end walls of the switch case body portion 12. This bottom wall 28 may include upwardly open recesses of the type shown at **28*a* in order to receive U-shaped fulcrum defining parts 30 having opposed leg portions defining notches 30*a*, in which notches laterally projecting portions of the movable contact member 18 are adapted to be received for more precisely determining the center "off" position of the switch while nevertheless allowing for pivotal movement of the movable member 18** as described above.

The lower or bottom wall 28 of the switch case body portion 12 has a substantial thickness, relative to the side walls for example, and the lower face **28*b* of the bottom wall 28 defines vertically extending downwardly opening slots for receiving flat planar terminals, some of which terminals are located at the corners of the generally rectangular body portion 12 as indicated generally at 32, 32 while other terminals 34, 34, to be called center terminals, are provided between these some or corner terminals 32, 32. The slots for receiving said terminals each define downwardly facing abutment surfaces 28*c* and 28*d* respectively for the center and corner terminals 34 and 32 respectively, which abutment surfaces 28*c* and 28*d* are located between the lower surface 28*b* of bottom wall 28** and its upper cavity defining surface referred to previously.

Figure 5:
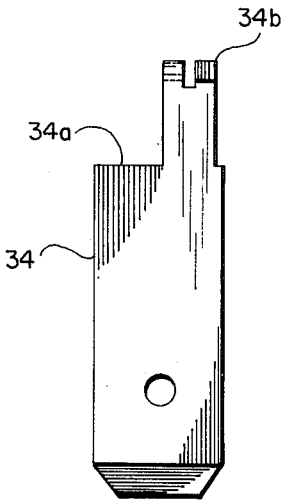
FIG. 5 is a side elevational view of a center terminal such as illustrated in FIG. 4.
Figure 6:
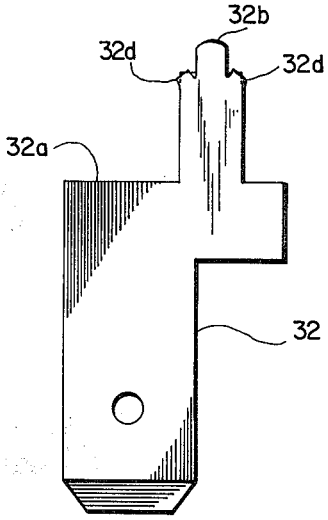
FIG. 6 is a side elevational view of a corner terminal such as illustrated in FIG. 4.

Turning next to a more complete description of the geometry for the terminals 32 and 34, FIGS. 5 and 6 show these conductive elements as comprising generally flat planar strips of conductive material, each of which has as downwardly extending blade portion for receiving a wire connector as suggested by the broken lines in FIG. 1, and each of which further includes an abutment edge **32*a* and 34*a*, which abutment edges are adapted to engage the downwardly facing abutment surfaces 28*c* and 28*d* defined in the bottom wall of the switch case body portion. Each of the corner terminals 32 has a contact defining upper portion 32*b* which portion 32*b* is offset from the blade defining portion at the lower end by an intermediate portion 32*c*. This intermediate portion 32*c* provides the area of maximum width for the terminal 32 and is adapted to be received within the corner slot referred to previously in the bottom wall 28** of the switch case.

It will be apparent from FIG. 1 that the corner slots in the bottom wall of the switch case are stepped so that each said slot has a downwardly facing abutment surface **28*d* for engagement by the abutment edge 32*a* defined on each corner terminal 32. This geometry serves to locate these corner terminals 32 vertically in the switch case 12 and permits the upper portion of the corner terminal 32 to be staked into place as suggested by the tabs 32*d* which are adapted to be upset from the broken line position suggested in FIG. 6 to the solid line position shown in that view. As so staked each of the corner terminals 32 is securely held in the switch case body portion 12 and more particularly in its bottom wall 28**.

Turning next to a more complete description of the center terminals 34 best shown in FIG. 5 each center terminal includes a downwardly extending blade portion similar to that described above with reference to the corner terminal 32. Furthermore, each center terminal also includes an intermediate portion defining the abutment edge **34*a* for engagement with the stepped slot surface 28*c* referred to previously in order to locate the center terminal 34 in its associated stepped slot in the bottom wall 28 of the switch case body portion 12. The upper portion 34*b* of the center terminal 34 includes projecting tabs as best shown in FIG. 5 which tabs are adapted to be bent in opposite directions out of the plane of the terminal 34 so as to secure the U-shaped fulcrum defining member 30 in its associated cavity 28*a* in the bottom wall of the switch case body portion 12. FIG. 3 shows these tabs as so upset with the result that each center terminal 34 is anchored in the switch case bottom wall 28 in much the same manner as that referred to previously with respect to the corner terminals 32, 32. The upper portion of center terminal 34 is offset from the lower blade defining portion thereof in much the same manner as referred to previously with respect to the corner terminal 32**.

Figure 4:
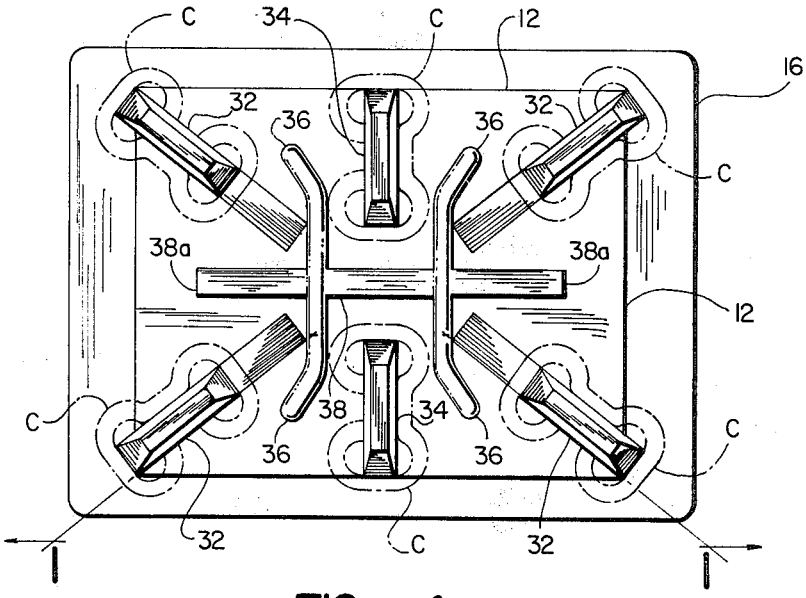
FIG. 4 is a bottom view of the switch case illustrated in FIG. 1.

The above described geometry for the corner terminals 32, 32 assures that adjacent corner terminals are electrically separated from one another even when connectors C are applied thereto (see FIG. 4). The same is true of the separation between said corner terminals 32 and center terminal 34. All such terminals and their associated connectors C, C are isolated from one another so that the likelihood of a spark or short between them is greatly reduced as a result of the geometry calling for corner terminals 32, 32 to be oriented parallel to the diagonals of the rectangular body portion 12 of the switch case. The outer edges of each corner terminal 32 are provided adjacent to the corners of the rectangular body portion 12 as shown in FIG. 4, and the vertically extending edge portions of these corner terminals 32 will be seen from FIG. 4 to be provided as remote from one another as is possible with the rectangular geometry for the body portion 12 of the switch case, that is, without detracting from the capability for such rectangular body portion 12 to be inserted into a panel opening 10 from the front of the panel is mentioned previously.

Same is true of the center terminals 34, 34 in that their outer edges are located in the plane of the longer sides for the rectangular body portion 12 as best shown in FIG. 4. The size and shape for the blade portions of the terminals 32 and 34 is dictated by the size and shape for the conventional connectors C, C. So too, the overall dimensions for the rectangular body portion 12 are determined by the overall dimensions for the miniature switch generally. As a result of locating and arranging the terminals 32 and 34 in the configuration shown in FIG. 4 it has been found possible to maintain a separation between conductive metallic parts of the terminals and their associated connectors C which separation is at least three millimeters as measured around dielectric wall means provided in the form of letter H in the bottom wall 28 of the switch case 12. More particularly, individual wall means defined by the legs of the H are provided between the center terminal 34 and corner terminals 32, 32. Thus, these legs 36, 36 of the H serve to electrically separate the inner portions of the terminal blades and connectors so that approximately three millimeters or better is provided between these metal conductive elements as measured in the air space around these wall means 36, 36.

The cross bar 38 of the H-shaped wall or skirt means has projecting portions 38*a*, 38*a* which serve to separate the inner ends of the corner terminals and their associated connectors by at least the same amount (that is three millimeters or more). By reference to FIGS. 1, 2 and 3 it will be apparent that the depending wall or skirt means formed integrally with the underside of the bottom wall of the switch case body portion does extend downwardly below the lower ends of the terminal 32 and 34 by an amount which, again, assures adequate separation between the metallic conductive connectors C, C together with their associated terminals 32 and 34. It should perhaps be noted that the outer edges of the legs 36, 36 and the projecting portions 38*a* of the cross bar 38 do terminate short of the peripheral edge of the rectangular body portion 12 in order to facilitate connecting these blade portions with a wire or the like through holes provided for this purpose in the depending blade portions of the terminals in the event that connectors C, C are not used for any reason. Thus, a very efficient design is portrayed in the present disclosure wherein the depending skirt means for electrically separating the conductive terminals and associated connectors from one another is no more massive than actually required for the purpose intended, namely to assure the requisite three millimeter air separation between adjacent conductive parts. As so constructed and arranged a miniature switch, capable of being front mounted in a panel or the like, nevertheless has the capability of being electrically coupled to relatively high voltage wires.

I claim:

1. An electric switch comprising a molded case of dielectric material and including a generally rectangular body portion, means for said case to be front mounted in a panel opening, said body portion defining an upwardly open cavity, at least one movable contact in said cavity, an operating member movably mounted in said case for selectively moving said movable contact, said body portion further including a bottom wall having slots defined therein, terminals in said switch case bottom wall, said terminals having lower blade portions for slidably receiving wire connectors, said blade portions projecting downwardly but arranged generally within the periphery of said rectangular body portion, upper portions of some of said terminals defining contacts which are selectively engageable by said movable contact, each of said some terminals having an intermediate portion in the plane of said blade portion and defining an offset between said upper contact defining portion and said lower blade portion such that said upper contact portion is located inside said switch cavity and said lower blade portion has at least one vertically extending edge located adjacent to an outside corner of said rectangular body portion said switch case body having an integrally formed divider wall in said cavity to define side-by-side subcavities, certain of said terminals in said bottom wall slots having upper portions in certain of said subcavities and other of said terminals having upper portions in the other of said subcavities, said some terminals having edges of their blade portions located adjacent at least two corners of said rectangular body portion said some terminals located with edges thereof adjacent said corners of said switch case body portion, at least one center terminal associated with one of said subcavities and located in a slot defined in said bottom wall so that one vertically extending edge of the blade portion of said center terminal is arranged adjacent to and in the plane of the long side of said rectangular body portion, said center terminal having its generally planar blade oriented perpendicular to said long side of said rectangular body portion each of said terminals comprising a flat strip of conductive material having a thickness which is constant throughout its length, said upper portion of each terminal having a width which is less than that of said intermediate portion to define an abutment edge on said terminal, said slots in said bottom wall being stepped so that each said slot has a downwardly facing abutment surface for engagement by said terminal abutment edge to locate said terminal in said switch case body portion.

2. A switch according to claim 1 wherein said planar terminals adjacent said corners of said body portion are oriented in generally parallel relation to the diagonals of the rectangular shape formed by said switch case body portion.

3. A switch according to claim 1 further characterized by depending skirt means integrally formed on the underside of the bottom wall of said switch case body portion, said skirt means having a generally H-shaped cross sectional geometry such that said some terminals at adjacent corners of said rectangular body portion are separated from each other and from said center terminal by said skirt means.

4. A switch according to claim 3 wherein said skirt means extends downwardly beyond said blade portions of said terminals, and wherein said H-shaped skirt means also includes projecting portions of the cross bar of the H, said H-shaped skirt means including outwardly flared portions of the side legs of the H, said flared portions and said projecting portions defining said H-shaped skirt means such that said skirt means is spaced inwardly of the periphery of said rectangular switch case body portion.

* * * * *